US006482355B1

(12) United States Patent
Santella et al.

(10) Patent No.: US 6,482,355 B1
(45) Date of Patent: Nov. 19, 2002

(54) WEDLABLE NICKEL ALUMINIDE ALLOY

(75) Inventors: Michael L. Santella, Knoxville, TN (US); Vinod K. Sikka, Oak Ridge, TN (US)

(73) Assignee: U T Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/396,059

(22) Filed: Sep. 15, 1999

(51) Int. Cl.[7] ..... C22C 19/05
(52) U.S. Cl. ..... 420/445; 148/428
(58) Field of Search ..... 420/445, 460; 148/428

(56) References Cited

U.S. PATENT DOCUMENTS 4,612,165 A 9/1986 Liu et al.
4,711,761 A 12/1987 Liu et al.
4,722,828 A 2/1988 Liu
4,731,221 A 3/1988 Liu
4,839,140 A 6/1989 Cathcart et al.
5,108,700 A 4/1992 Liu
5,413,876 A 5/1995 Santella et al.

*Primary Examiner*—Roy King
*Assistant Examiner*—Harry D. Wilkins, III
(74) *Attorney, Agent, or Firm*—J. Herbert O'Toole; Nexsen Pruet Jacobs & Pollard, LLC

(57) ABSTRACT

A $Ni_3Al$ alloy with improved weldability is described. It contains about 6–12 wt % Al, about 6–12 wt % Cr, about 0–3 wt % Mo, about 1.5–6 wt % Zr, about 0–0.02 wt % B and at least one of about 0–0.15 wt % C, about 0–0.20 wt % Si, about 0–0.01 wt % S and about 0–0.30 wt % Fe with the balance being Ni.

13 Claims, No Drawings

WEDLABLE NICKEL ALUMINIDE ALLOY

The U.S. Government has rights in this invention pursuant to contract No. DE-AC 05-960R22464 between the Department of Energy and Lockheed Martin Energy Research Corporation.

BACKGROUND OF THE INVENTION

This invention relates generally to the art of alloys and more particularly to a novel nickel aluminide alloy having improved welding characteristics.

The following U.S. patents have issued on nickel aluminide alloys:

4,612,165 Ductile Aluminide Alloys for High Temperature Applications 4,711,761 Ductile Aluminide Alloys for High Temperature Applications 4,722,828 High-Temperature Fabricable Nickel-Iron Aluminides 4,731,221 Nickel Aluminides and Nickel-Iron Aluminides for use in Oxidizing Environments 4,839,140 Chromium Modified Nickel-Iron Aluminide Useful in Sulfur Bearing Environments 5,108,700 Castable Nickel Aluminide Alloys for Structural Applications 5,413,876 Nickel Aluminide Alloys with Improved Weldability Each of these patents, which are hereby incorporated by reference, disclose only major alloy elements. For example, the alloy called IC221, disclosed in U.S. Pat. No. 4,731,221 is a composition of Ni—16.1A1—1. OZr—8.0Cr at %.

In reality, alloys produced and processed by commercial practices contain other alloying elements. For example, these elements may occur in the finished alloy due to contamination of scrap materials used in melting, or through the interaction of liquid alloy with molding materials used to make metal castings. Some of the unintentionally added elements, termed "minor elements", may have little or not adverse effect on the subsequent properties of an alloy. Other of these unintentionally added elements may be highly undesirable.

Minor elements that are known to produce undesirable effects in high-strength, high-temperature Ni-based alloys, like nickel aluminide alloys, include boron, carbon, silicon and sulfur. Boron may be intentionally added to nickel aluminide alloys to improve ductility. However, high boron concentrations, above about 0.01 wt %, are known to cause difficulties with certain properties such as weldability. Experience shows that carbon, silicon and sulfur are common minor elements in nickel aluminide alloys prepared under industrial conditions. Concerns about the possible detrimental effects of these elements leaves a need to more thoroughly define the desirable chemical composition ranges of nickel aluminide alloys such as IC221.

SUMMARY OF THE INVENTION

It is an object of this invention to provide a novel nickel aluminide alloy.

It is further an object of this invention to find such an alloy with improved welding characteristics.

These as well as other objects are accomplished by an alloy comprising a nickel aluminide alloy having improved welding characteristics comprising about 6–12 wt % aluminum, about 6–12 wt % chromium, about 0–3 wt % molybdenum, about 0–6 wt % zirconium, about 0–0.02 wt % boron, about 0.01–0.15 wt % carbon, about 0.01–0.20 wt % silicon, about 0.001–0.010 wt %, sulphur, about 0.01–0.30 wt % iron, and balance nickel.

DETAILED DESCRIPTION

In the course of this invention it has been found that minor additions to the nickel aluminide alloy identified as IC221 in limited amounts greatly enhance the welding characteristics of this alloy. Various other advantages and features will be apparent from the reading of the following description.

IC221M (containing molybdenum) alloy is used for cast components for a variety of industrial settings. Castings routinely require welding, either for cosmetic repairs, structural repairs, or for attachment to other components. The importance of welding to the commercialization efforts for the IC221M alloy, and the general sensitivity of welding response of Ni-based alloys to minor elements make it a target for better definition and refinement in accordance with this invention.

A series of castings was made by induction melting pure charge materials under a cover of argon gas, and then pouring the melted alloys into permanent molds with dimensions of 25×100×150 mm. The analyzed chemical compositions of the castings are given in Table I. These cast plates were then prepared for welding with beveled edges. In some cases, weld beads were alternated between opposite sides of the weldment using a double "V" configuration to control distortion. In other cases a singe-vee configuration was used, and the plates were rigidly restrained. The second condition represents an extreme situation that may be encountered in practice, and where the tendency for weld cracking will be maximized. For both edge preparations, the included angles of the beveled plates were 60°.

TABLE I

Chemical Compositions of Nickel Aluminide Castings

| | Chemical analysis report, wt % | | | | | | | | | | | | | | | |
|---|---|---|---|---|---|---|---|---|---|---|---|---|---|---|---|---|
| Heat No. | Ni | Al | Cr | Mo | Zr | B | C | S | Si | Fe | Co | Nb | Ti | V | N | O |
| 16341 | bal. | 8.03 | 7.49 | 1.43 | 2.43 | 0.008 | 0.011 | 0.001 | 0.01 | 0.02 | 0.01 | <0.01 | 0.08 | <0.01 | 0.004 | 0.008 |
| 16342 | bal. | 8.15 | 7.41 | 1.43 | 2.40 | 0.007 | 0.11 | 0.001 | <0.01 | 0.02 | <0.01 | <0.01 | 0.01 | <0.01 | 0.007 | 0.002 |
| 16343 | bal. | 7.95 | 7.54 | 1.47 | 2.80 | 0.006 | 0.49 | 0.001 | <0.01 | 0.02 | <0.01 | <0.01 | <0.01 | <0.01 | 0.008 | 0.004 |
| 16350 | bal. | 8.14 | 7.56 | 1.44 | 2.00 | 0.008 | 0.11 | 0.002 | <0.01 | 0.03 | <0.01 | <0.01 | <0.01 | <0.01 | 0.012 | 0.006 |
| 16354 | bal. | 8.15 | 7.56 | 1.44 | 1.78 | 0.008 | 0.11 | 0.001 | 0.01 | 0.02 | 0.01 | <0.01 | <0.01 | <0.01 | 0.004 | 0.003 |
| 16355 | bal. | 8.18 | 7.54 | 1.44 | 1.57 | 0.007 | 0.15 | 0.002 | 0.01 | 0.02 | 0.01 | <0.01 | <0.01 | <0.01 | 0.007 | 0.003 |
| 16357 | bal. | 8.35 | 7.83 | 1.44 | 1.49 | 0.015 | 0.11 | 0.003 | 0.06 | 0.28 | <0.01 | <0.01 | <0.01 | <0.01 | 0.009 | 0.006 |
| 16360 | bal. | 8.29 | 7.81 | 1.44 | 1.88 | 0.015 | 0.11 | 0.003 | 0.06 | 0.28 | <0.01 | <0.01 | <0.01 | <0.01 | 0.011 | 0.003 |

TABLE I-continued

Chemical Compositions of Nickel Aluminide Castings

| Heat No. | Chemical analysis report, wt % | | | | | | | | | | | | | | | |
|---|---|---|---|---|---|---|---|---|---|---|---|---|---|---|---|---|
| | Ni | Al | Cr | Mo | Zr | B | C | S | Si | Fe | Co | Nb | Ti | V | N | O |
| 16362 | bal. | 8.32 | 7.81 | 1.44 | 1.92 | 0.023 | 0.11 | 0.003 | 0.06 | 0.29 | <0.01 | <0.01 | <0.01 | <0.01 | 0.013 | 0.002 |
| 16364 | bal. | 8.33 | 7.76 | 1.44 | 1.98 | 0.002 | 0.11 | 0.003 | 0.07 | 0.28 | <0.01 | <0.01 | <0.01 | <0.01 | 0.008 | 0.002 |
| 16388 | bal. | 8.41 | 7.84 | 1.44 | 2.03 | 0.014 | 0.11 | 0.004 | 0.12 | 0.32 | <0.01 | <0.01 | 0.06 | <0.01 | 0.007 | 0.002 |
| 16389 | bal. | 8.37 | 7.86 | 1.44 | 2.02 | 0.015 | 0.099 | 0.008 | 0.06 | 0.28 | <0.01 | <0.01 | 0.02 | <0.01 | 0.009 | 0.001 |
| 16390 | bal. | 8.39 | 7.93 | 1.44 | 2.11 | 0.015 | 0.10 | 0.009 | 0.12 | 0.28 | <0.01 | <0.01 | <0.01 | <0.01 | 0.007 | 0.001 |
| 16427 | bal. | 8.31 | 7.88 | 1.44 | 2.01 | 0.014 | 0.11 | 0.007 | 0.12 | 0.28 | 0.01 | <0.01 | <0.01 | <0.01 | 0.006 | 0.003 |
| 16428 | bal. | 8.32 | 7.75 | 1.44 | 2.00 | <0.001 | 0.11 | 0.002 | 0.07 | 0.29 | 0.01 | <0.01 | <0.01 | <0.01 | 0.007 | 0.003 |
| 16352 | bal. | 8.37 | 7.69 | 1.44 | 1.99 | 0.008 | 0.10 | 0.008 | 0.12 | 0.28 | <0.01 | <0.01 | <0.01 | <0.01 | 0.009 | 0.006 |
| 16353 | bal. | 8.28 | 7.56 | 1.45 | 1.97 | 0.008 | 0.10 | 0.009 | 0.20 | 0.28 | <0.01 | <0.01 | <0.01 | <0.01 | 0.007 | 0.003 |
| 16354 | bal. | 8.24 | 7.73 | 1.45 | 2.06 | 0.008 | 0.11 | 0.009 | 0.39 | 0.28 | <0.01 | <0.01 | <0.01 | <0.01 | 0.010 | 0.003 |

TABLE II

WELDING RESULTS

| Melt No. | Joint design | Restraint | Welding Results |
|---|---|---|---|
| 16341 | double vee | no | OK |
| 16342 | double vee | no | OK |
| 16343 | double vee | no | Centerline crack in root bead |
| 16350 | double vee | no | OK |
| 16354 | double vee | no | OK |
| 16355 | double vee | no | OK |
| 16357 | double vee | no | Centerline crack in root pass |
| 16360 | double vee | no | OK |
| 16362 | double vee | no | Centerline crack started on 2nd bead |
| 16364 | double vee | no | OK |
| 16388 | single vee | yes | 20 beads; cracked in base metal |
| 16389 | single vee | yes | Centerline crack in root pass |
| 16390 | single vee | yes | 22 beads; cracked in base metal |
| 16427 | single vee | yes | OK |
| 16428 | single-vee | yes | OK |
| 16352 | single-vee | yes | OK |
| 16353 | single-vee | yes | OK |
| 16354 | single vee | yes | 15 beads; cracked in base metal |

Each weld was made by the gas tungsten arc process using argon shielding gas. The welding electrode used was the IC221LA alloy, which has a nominal composition of Ni—16Cr—4.5 Al—1.5 Zr—1.2 Mo 0.004—B wt %.

Melt numbers 16341, 16342, and 16343 were formulated to assess the effect of the element carbon on the response of the cast plates to welding. In these three castings, the concentrations of iron, sulfur and silicon were kept as low as possible, and the boron concentration was maintained at a level judged to be the optimum for these alloys, equal to or less than 0.008 wt %. The welds made with these plates were of the double-vee configuration without restraint. In the alloys with 0.011 wt % C and 0.11 wt % C welding proceeded without cracking. In the alloy with 0.49 wt % C, the first deposited weld bead cracked. Based on these results, the maximum carbon level that can be tolerated in IC221M without adversely affecting welding is in the range 0.11–0.49 wt %.

Melt numbers 16350, 16354, and 16355 were formulated to assess the combined effects of carbon and zirconium. An acceptable weld was made in each of these plates. These results indicate that carbon concentrations up to 0.15 wt % can be tolerated at zirconium concentrations as low as 1.57 wt %. It was found that as the concentration of zirconium in IC221M increased the tolerance for minor elements, boron, carbon, sulfur, and silicon is also increased.

Melt numbers 16357 and 16360 were formulated to assess the relationship of zirconium concentration to that of the combined minor elements (B, C, S, Si). In both of these alloys, the boron concentration was nearly double its optimum level. The carbon concentration was set at 0.11 wt %. The sulfur and silicon levels were also increased to 0.003 wt % and 0.06 wt %, respectively. The response of these plates to welding showed that an acceptable weld could be made only in plates with higher zirconium concentrations of 1.88 wt %.

Melt numbers 16362 and 16364 were formulated to assess the limits of acceptability for boron concentration. Welding of these plates showed that the boron concentration of 0.002 wt % was acceptable for welding, while 0.023 wt % was not.

Melt numbers 16388, 16389 and 16390 were formulated to assess the effects of silicon and sulfur concentrations. The boron concentration in these alloys was set near the acceptable limit of 0.015 wt %, and the zirconium concentration was held near 2 wt %. In melt number 16388, the silicon concentration was elevated to 0.12 wt % and the sulfur concentration was held at 0.004 wt %. In melt number 16389, the sulfur concentration was elevated to 0.008 wt %, and the silicon concentration was held at 0.06 wt %. In melt number 16390, both the silicon and sulfur concentrations were elevated. The response of these alloys to welding indicated that elevated sulfur concentration near 0.010 wt % is detrimental to welding.

Melt numbers 16352, 16353 and 16354 were formulated to assess the effects of only silicon concentration. Difficulties were experienced welding only the alloy with the highest silicon concentration.

Based on these results, the following chemical composition is the preferred embodiment of this invention: 6–12 wt % aluminum, about 6–12 wt % chromium, up to about 3 wt % molybdenum, up to about 6 wt % zirconium, up to about 0.02 wt % boron, about 0.01–0.15 wt % carbon, about 0.01–0.20 wt % silicon, about 0.001–0.010 wt % sulfur, and about 0.02–0.30 wt % iron balance nickel.

The following general observations can be made with regard to the various constituents to the alloy of this invention. Zirconium within the ranges specified generally tends to prevent cracking. Boron, on the other hand, outside the ranges specified tends to promote cracking but also has the beneficial effect of counteracting the effects of sulfur which tends to promote cracking. Sulfur, however, tends to be generally an impurity within the composition, as is silicon which tends to promote cracking as well. Thus, the composition of the alloys of this invention are realistic commercial alloys for welding applications.

This invention provides a more thorough definition and justification of the chemical composition of the IC221M alloy. The alloy in accordance with this invention is subject to any of the applications disclosed in U.S. Pat. No. 5,824,166 to McDonald which is hereby incorporated by reference.

It is thus seen that this invention provides a novel nickel aluminide alloy having improved welding characteristics. Various modifications will become apparent to those skilled in the art from a reading of the above description which is exemplary in nature. Such modifications, however, are embodiments of the spirit and scope of this invention as defined by the following appended claims.

What is claimed is:

1. A $Ni_3Al$ alloy having improved welding characteristics comprising:

about 6–12 wt % aluminum, about 6–12 wt % chromium, about 0–3 wt % molybdenum, about 1.5–6 wt % zirconium, about 0–0.02 wt % boron, about 0.01–0.30 wt % iron, and at least one of the following being present, about 0–0.15 wt % carbon, about 0–0.20 wt % silicon, and about 0–0.01 wt % sulphur, and balance nickel.

2. The $Ni_3Al$ alloy according to claim 1 wherein carbon is present within the range of 0.01–0.15 et %.

3. The $Ni_3Al$ alloy according to claim 1 wherein silicon is present with the range of about 0.01–0.20 wt %.

4. The $Ni_3Al$ alloy according to claim 1 wherein sulphur is present within the range of about 0.001–0.01 wt %.

5. The $Ni_3Al$ alloy according to claim 1 comprising:

8.32 wt % aluminum, 7.75 wt % chromium, 1.44 wt % molybdenum, 2.00 wt % zirconium, less than 0.001 wt % boron, 0.11 wt % carbon, 0.002 wt % sulphur, 0.07 wt % silicon, 0.29 wt % iron, balance substantially all nickel.

6. The $Ni_3Al$ alloy according to claim 1 comprising:

8.29 wt % aluminum, 7.81 wt % chromium, 1.44 wt % molybdenum, 1.88 wt % zirconium, 0.015 wt % boron, 0.11 wt % carbon, 0.003 wt % sulphur, 0.06 wt % silicon, 0.28 wt % iron, balance substantially all nickel.

7. A welded article comprising two segments connected by a weld there between, each segment formed from a $Ni_3Al$ alloy comprising:

about 6–12 wt % aluminum, about 6–12 wt % chromium, about 0–3 wt % molybdenum, about 1.5–6 wt % zirconium, about 0–0.02 wt % boron, about 0.01–0.30 wt % iron, and at least one of the following being present, about 0–0.15 wt % carbon, about 0–0.20 wt % silicon, and about 0–0.01 wt % sulphur, and balance nickel.

8. The welded article according to claim 7 wherein carbon is present within the range of 0.01–0.15 wt %.

9. The welded article according to claim 7 wherein silicon is present with the range of about 0.01–0.20 wt %.

10. The welded article according to claim 7 wherein sulphur is present within the range of about 0.001–1.01 wt %.

11. The welded article according to claim 7 comprising:

8.32 wt % aluminum, 7.75 wt % chromium, 1.44 wt % molybdenum, 2.00 wt % zirconium, less than 0.001 wt % boron, 0.11 wt % carbon 0.002 wt % sulphur, 0.07 wt % silicon, 0.29 wt % iron, balance substantially all nickel.

12. The welded article according to claim 7 comprising:

8.29 wt % aluminum, 7.81 wt % chromium, 1.44 wt % molybdenum, 1.88 wt % zirconium, 0.015 wt % boron, 0.11 wt % carbon, 0.003 wt % sulphur, 0.06 wt % silicon, 0.28 wt % iron, balance substantially all nickel.

13. The article according to claim 7 wherein said weld is formed by a gas tungsten arc with a welding electrode comprising nickel, aluminum, zirconium, molybdenum and boron.

* * * * *

UNITED STATES PATENT AND TRADEMARK OFFICE

CERTIFICATE OF CORRECTION

PATENT NO. : 6,482,355 B1
DATED : November 19, 2002
INVENTOR(S) : Santella et al.

It is certified that error appears in the above-identified patent and that said Letters Patent is hereby corrected as shown below:

Title page, Item [54] and Column 1, line 1,
Title should read as follows:
-- WELDABLE NICKEL ALUMNIDE ALLOY --

Signed and Sealed this

Thirteenth Day of May, 2003

JAMES E. ROGAN
*Director of the United States Patent and Trademark Office*